US011686315B2

(12) United States Patent
Cunnane

(10) Patent No.: US 11,686,315 B2
(45) Date of Patent: Jun. 27, 2023

(54) CEILING FAN AND IMPELLER BLADE

(71) Applicant: HUNTER FAN COMPANY, Memphis, TN (US)

(72) Inventor: Jeffrey Butler Cunnane, Phoenix, AZ (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 16/989,999

(22) Filed: Aug. 11, 2020

(65) Prior Publication Data

US 2022/0049707 A1 Feb. 17, 2022

(51) Int. Cl.

| | |
|---|---|
| ***F04D 25/08*** | (2006.01) |
| ***F04D 29/34*** | (2006.01) |
| ***F04D 29/38*** | (2006.01) |
| *F21V 33/00* | (2006.01) |

(52) U.S. Cl.

CPC ..... *F04D 25/088* (2013.01); *F04D 29/34* (2013.01); *F04D 29/388* (2013.01); *F21V 33/0096* (2013.01)

(58) Field of Classification Search

CPC ..... F04D 25/088; F04D 29/34; F04D 29/388; F21V 33/0096

USPC ..... 416/62

See application file for complete search history.

(56) References Cited

U.S. PATENT DOCUMENTS

| | | | | |
|---|---|---|---|---|
| 3,270,656 | A * | 9/1966 | Cook | F04D 25/14 415/218.1 |
| 4,089,618 | A | 5/1978 | Patel | |
| 4,441,857 | A | 4/1984 | Jackson et al. | |
| 4,473,000 | A * | 9/1984 | Perkins | F04D 25/088 454/299 |
| 5,088,665 | A | 2/1992 | Vijgen et al. | |
| 5,275,535 | A | 1/1994 | Gongwer | |
| 5,603,607 | A | 2/1997 | Kondo et al. | |
| 5,883,449 | A * | 3/1999 | Mehta | H02K 5/18 310/58 |
| 6,059,541 | A * | 5/2000 | Beckey | A01G 20/47 415/121.2 |
| 6,379,116 | B1 * | 4/2002 | Tai | F04D 29/5806 416/93 R |
| 9,631,627 | B2 * | 4/2017 | Avedon | F04D 25/088 |
| 9,651,056 | B2 | 5/2017 | Ikeda et al. | |
| 9,803,649 | B2 | 10/2017 | Ragg et al. | |
| 9,829,004 | B2 | 11/2017 | Ikeda et al. | |
| 10,393,138 | B2 | 8/2019 | Gebert et al. | |
| 10,507,422 | B2 * | 12/2019 | Combs | F04D 29/703 |
| 10,989,207 | B2 * | 4/2021 | Kraft | F04D 29/005 |
| 2002/0081107 | A1 * | 6/2002 | Reiker | F24H 3/0411 392/364 |
| 2003/0002986 | A1 * | 1/2003 | Pauly | F04D 17/08 416/186 R |

(Continued)

*Primary Examiner* — Logan M Kraft
*Assistant Examiner* — John D Bailey
(74) *Attorney, Agent, or Firm* — McGarry Bair PC

(57) ABSTRACT

A ceiling mounted fan or ceiling fan includes a body defining an interior passage having an inlet and an outlet provided on the body. The inlet, outlet, and interior passage can be annular. An impeller mounted is mounted within the interior passage and driven by a motor mounted within the body to draw a volume of air through the interior passage from the inlet to the outlet. The impeller blades include a set of extensions extending from the tip.

18 Claims, 9 Drawing Sheets

(56) References Cited

U.S. PATENT DOCUMENTS

| | | | | |
|---|---|---|---|---|
| 2004/0170497 | A1* | 9/2004 | Snyder | F04D 25/06 415/206 |
| 2005/0180849 | A1* | 8/2005 | Chen | F04D 29/326 415/220 |
| 2006/0285977 | A1* | 12/2006 | Ming | F04D 25/088 416/243 |
| 2008/0008544 | A1* | 1/2008 | VanElverginghe | E04H 12/2238 406/99 |
| 2008/0253896 | A1* | 10/2008 | Walls | F04D 25/088 416/223 R |
| 2009/0175726 | A1* | 7/2009 | Rosati | F04D 29/368 416/241 A |
| 2014/0241894 | A1* | 8/2014 | Brownell | F04D 19/002 416/223 R |
| 2014/0348658 | A1* | 11/2014 | Cunnane | F04D 29/441 416/223 R |
| 2015/0275922 | A1* | 10/2015 | Son | B21D 11/20 415/206 |
| 2016/0161134 | A1* | 6/2016 | Choo | F04D 17/16 415/206 |
| 2017/0051749 | A1* | 2/2017 | Cho | F04D 29/663 |
| 2017/0367550 | A1* | 12/2017 | Shiozawa | F04D 29/444 |
| 2018/0195526 | A1* | 7/2018 | Hakozaki | F04D 29/34 |
| 2019/0120248 | A1* | 4/2019 | Whitmire | F04D 29/4226 |
| 2019/0234423 | A1* | 8/2019 | Schaafsma | F04D 29/547 |
| 2019/0242391 | A1* | 8/2019 | Whitmire | F04D 17/165 |
| 2019/0269871 | A1* | 9/2019 | Kenyon | A61M 16/024 |
| 2019/0345946 | A1* | 11/2019 | Register | F04D 17/04 |
| 2019/0374732 | A1* | 12/2019 | Cariola | F04D 29/66 |
| 2021/0254632 | A1* | 8/2021 | Umematsu | F04D 25/08 |

* cited by examiner

CEILING FAN AND IMPELLER BLADE

TECHNICAL FIELD OF INVENTION

This invention and disclosure relate to the field of ceiling fans for moving air. More specifically, the disclosure relates to a ceiling fan with a radial impeller, as compared to traditional fan blades, for moving a volume of air about a room or space.

BACKGROUND OF THE INVENTION

Ceiling fans typically include a set of blades rotatably coupled to a motor assembly to rotate the set of blades. The blades are driven by a motor and used to move a volume of air in an axial direction to be moved about a space. However, the particular shape or design of the blades can result in vibration or noise, which can be undesirable to the consumer or damaging to the structure of the ceiling fan.

Some ceiling fans drive a volume of air with an impeller. However, the impeller structure can result in vibrations or sonic vibrations, which can cause noise or damage to the ceiling fan, as well as reduce operating efficiency. Furthermore, there is a desire for a ceiling fan that does not have exposed blades, which can be cause damage if contacted while operating, or can cause flickering shadows during operation which may be undesirable.

BRIEF DESCRIPTION OF THE INVENTION

In one aspect, the disclosure relates to a ceiling fan comprising: a body defining an air flow passage with an inlet and an outlet provided on the body; a motor having a rotor, with at least a portion of the rotor located within the body; an impeller mounted to the rotor to move air through the air flow passage; and a set of blades provided on the impeller, with at least one blade of the set of blades extending from a root to a tip in a span-wise direction, and extending from a first edge to a second edge defining a chord-wise direction, wherein at least some of blades have a tip that includes an extensions extending outward at the tip.

In another aspect, the disclosure relates to a blade for a ceiling fan impeller, the blade comprising: a body extending between a root and a tip, defining a span-wise direction, and extending between a first edge and a second edge, defining a chord-wise direction; a set of extensions extending from the body at the tip.

In yet another aspect, the disclosure relates to an impeller for a ceiling fan comprising: a set of blades coupled to the impeller and extending radially from a hub; wherein each blade of the set of blades includes a root and a tip, wherein the tip includes a set of deltate extensions extending radially outwardly from the blade.

DETAILED DESCRIPTION OF EMBODIMENTS

Figure 1:
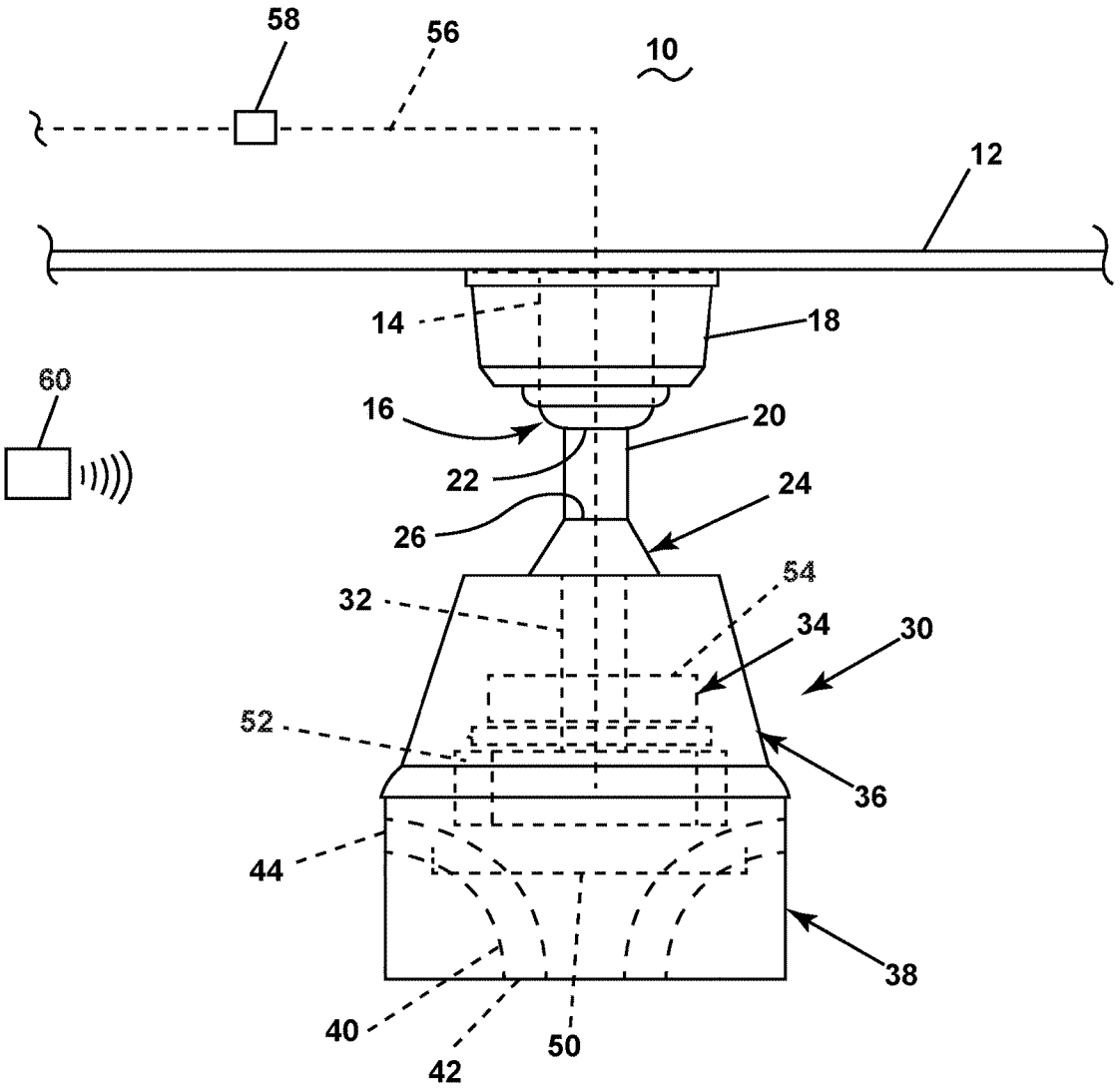
FIG. 1 is a schematic section view of a ceiling fan including an interior passage and an impeller.

The disclosure provided herein relates to an impeller blade for a ceiling fan or other air-movement machine, and more specifically, to an impeller-type ceiling fan vane or blade with a deltate or toothed blade tip or tips to reduce vibration and noise, as well increasing efficiency or maintaining efficiency while reducing vibration and noise.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary. As used herein, the term "set" or a "set" of elements can be any number of elements, including only one.

Referring to FIG. 1, a ceiling fan 10 can be suspended from a structure, such as a ceiling 12. Other suitable structures include a wall, a post, a beam, etc. While this disclosure describes mounting the ceiling fan 10 to a ceiling for the sake of tradition and convenience, the mounting to a ceiling is exemplary and is not meant to be limiting. A ceiling mount 14 can mount to the ceiling 12 to suspend the ceiling fan 10, and can include a seat with a ball mount 16. A canopy 18 can be used to cover the ceiling mount 14. A downrod 20 extends from the ball mount 16 at a first end 22 and to a motor adapter 24 at a second end 26.

A motor housing 30 encases a motor assembly 34, which suspends from the downrod 20 at the motor adapter 24 via a motor shaft 32. The motor housing 30 can be separated into an upper portion 36 and a lower portion 38, for example, while it is contemplated that the motor housing 30 can be a single or unitary portion, and the upper and lower portions 36, 38 are merely for facilitating understanding of the disclosure. The lower portion 38 includes an annular airflow passage 40 extending from an inlet 42 to an outlet 44. While the inlet 42 is shown on the bottom surface of the lower portion 38 and the outlet 44 is on the sides, it should be understood that such an arrangement is exemplary, and other configurations defining the airflow passage 40 are contemplated, and that the ceiling 10 is shown schematically.

An impeller 50 is provided within the airflow passage 40 to move a volume of fluid or air along the airflow passage 40 from the inlet 42 to the outlet 44. A motor 52 is mounted within the motor housing 30 and operably coupled to the impeller 50 to drive the impeller 50 to move a volume of air through the airflow passage 40.

A controller 54 can be included with the ceiling fan 10 for operating the ceiling fan 10. A power supply 56 can couple to the ceiling fan 10 to power operation of the ceiling fan 10, such as via the controller 54. A remote controller, such as a wall switch 58 or a wireless remote 60 can be used to control operation of the ceiling fan 10.

Figure 2:
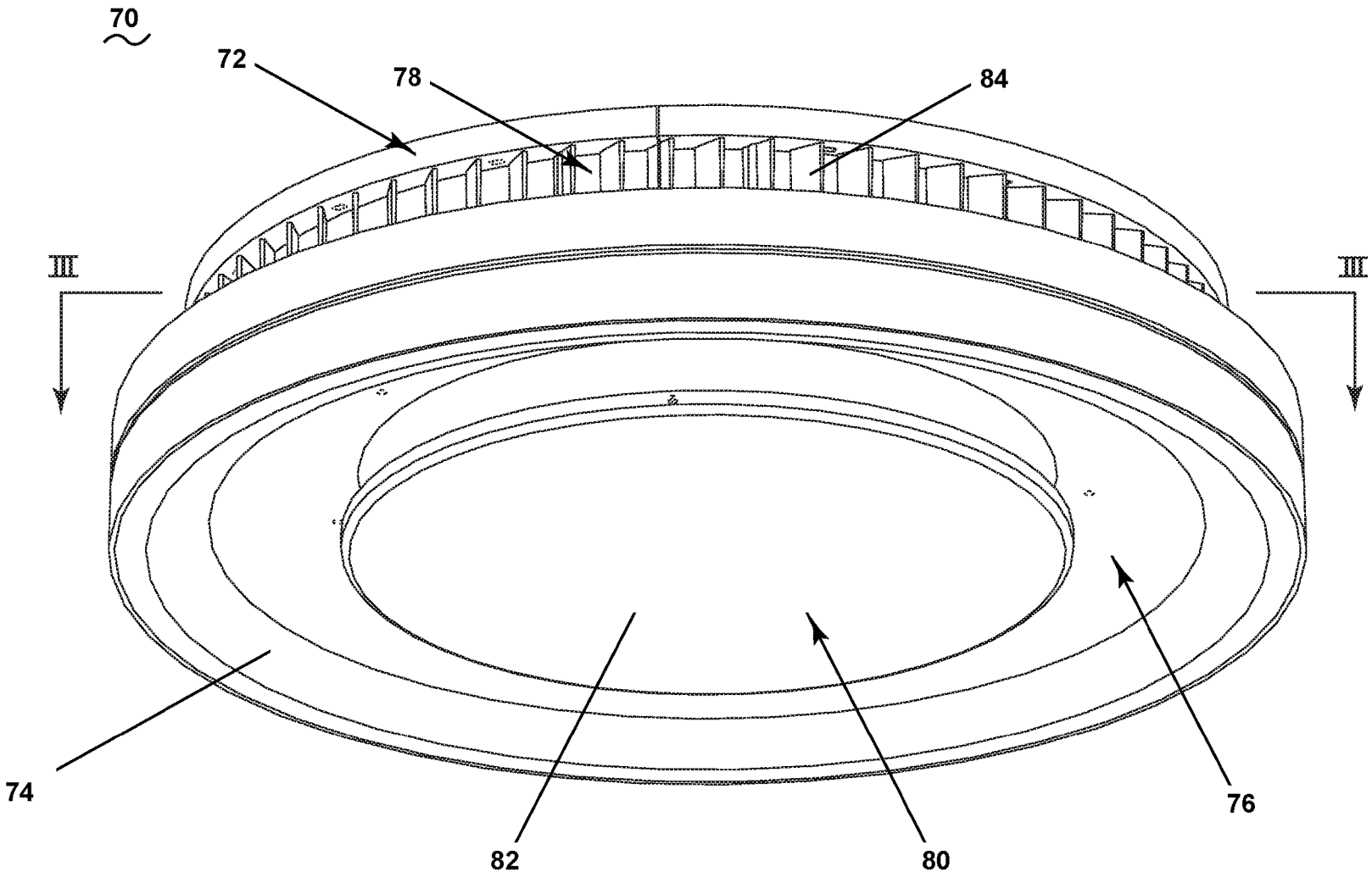
FIG. 2 is a bottom perspective view of the ceiling fan of FIG. 1.

Referring now to FIG. 2, a ceiling fan 70 is shown, which can be similar to the ceiling fan 10 of FIG. 1, except that the ceiling fan 70 can be mounted to the ceiling or other structure without the canopy 18, downrod 20, or motor adapter 24, or other similar features. Therefore, it should be understood that the ceiling fan 70 of FIG. 2 is akin to a low-profile version of the ceiling fan 10 of FIG. 1.

The ceiling fan 70 includes a housing 72 with a body 74. An inlet 76 and an outlet 78 is defined on the housing 72. The inlet 76 and outlet 78 can be annular, extending around the circumference of the body 74. It should be understood that the inlet 76 and outlet 78 can be switched based upon a direction of airflow moving through the body 74 of the ceiling fan 70, such that the inlet 76 can be an outlet and the outlet 78 can be an inlet. Furthermore, the positions of the inlet 76 and outlet 78 need not be limited as shown, and can vary based upon the particular structure of geometry of the housing 72.

A bottom cover 80 can be mounted to the body 74 at the bottom of the housing 72, and can partially define the inlet 76. Optionally, the bottom cover 80 can include a light or light kit 82, for providing lighting to the room or space in which the ceiling fan 70 is provided. A cage 84 can be provided at the outlet 78, protecting the interior features of the ceiling fan 70.

Figure 3:
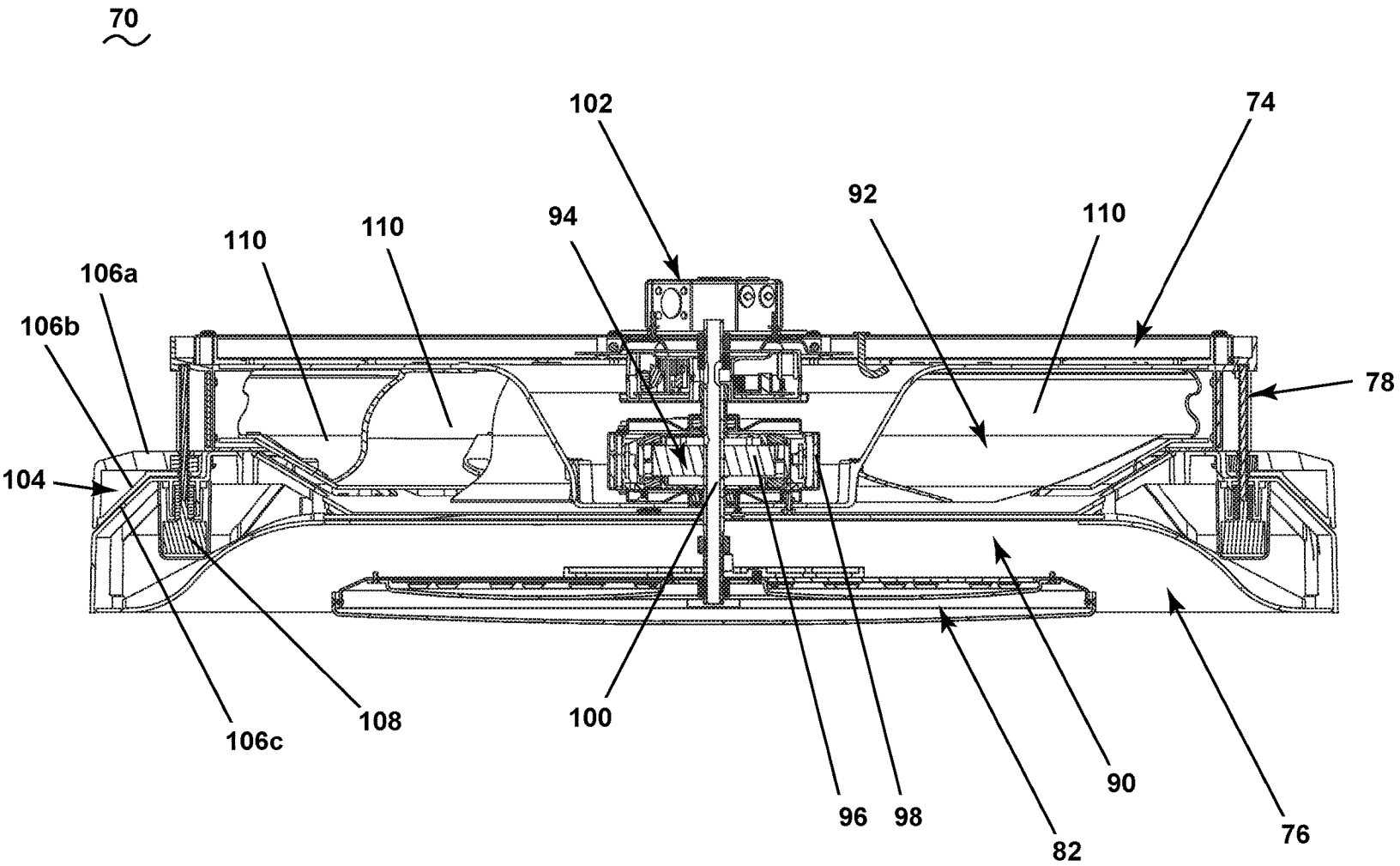
FIG. 3 is a section view of the ceiling fan of FIG. 2, taken along section of FIG. 2.

Referring to FIG. 3, the body 74 further defines an interior passage 90 extending between the inlet 76 and the outlet 78. An impeller 92 is provided within the body 74, and is rotatable within the interior passage 90 to drive a volume of air between the inlet 76 and the outlet 78.

A motor assembly 94 is provided within the body 74 and operably coupled to the impeller 92. The motor assembly 94 can include a stator 96 surrounded by a rotor 98 or drive shaft, with the rotor 98 rotatably driven by the stator 96 and driving rotation of the impeller 92. A motor shaft 100 can extend through the motor assembly 94 for suspending the motor assembly 94 from the ceiling.

A mounting structure 102, which can include or comprise an electrical box, can mount and electrically couple the ceiling fan 70 to the ceiling or structure, and suspend the body 74 during installation. The motor shaft 100 can couple to the mounting structure 102 for suspending motor assembly 94 from the ceiling or structure. The motor shaft 100 can be hollow to provide for electrical connections to power the motor assembly 94 or the light kit 82.

A diverter 104 is also provided on the housing 72, and can extend annularly about the fan 70. The diverter 104 includes an upper surface 106*a*, and a lower angled surface 106*b*. A housing angled surface 106*c* is formed on the housing 72, and can be sized and shaped complementary to the lower angled surface 106*b*. As shown, in a first position, the diverter 104 directs an airflow exhausting from the outlet 78 along the upper surface 106*a*, such that the airflow can be moved radially outwardly from the fan 70, along the ceiling of the structure. Alternatively, the diverter 104 can move upwardly, to a second position (not shown) having the diverter 104 moved upwardly, such that the outlet is defined between the lower angled surface 106*b* and the housing angled surface 106*c*, where air exhausting from the outlet 78 is directed downwardly along the lower angled surface 106*b* and the housing angled surface 106*c*. Therefore, the ceiling fan 70 is capable of moving a volume of air along the ceiling, when the diverter 104 is in the first position, as shown, and capable of moving an airflow downwardly, relative to the horizontal, when the diverter 70 is in the second position, where exhausted air is directed downwardly along the lower angled surface 106*b* and the housing angled surface 106*c*. An actuator 108 can provide for moving the diverter 104 between the first and second positions.

The impeller 92 includes a set of blades 110, which drive a volume of air during rotation of the impeller 92. In one example, the impeller 92 can include six blades, while any suitable number of blades is contemplated.

Figure 4:
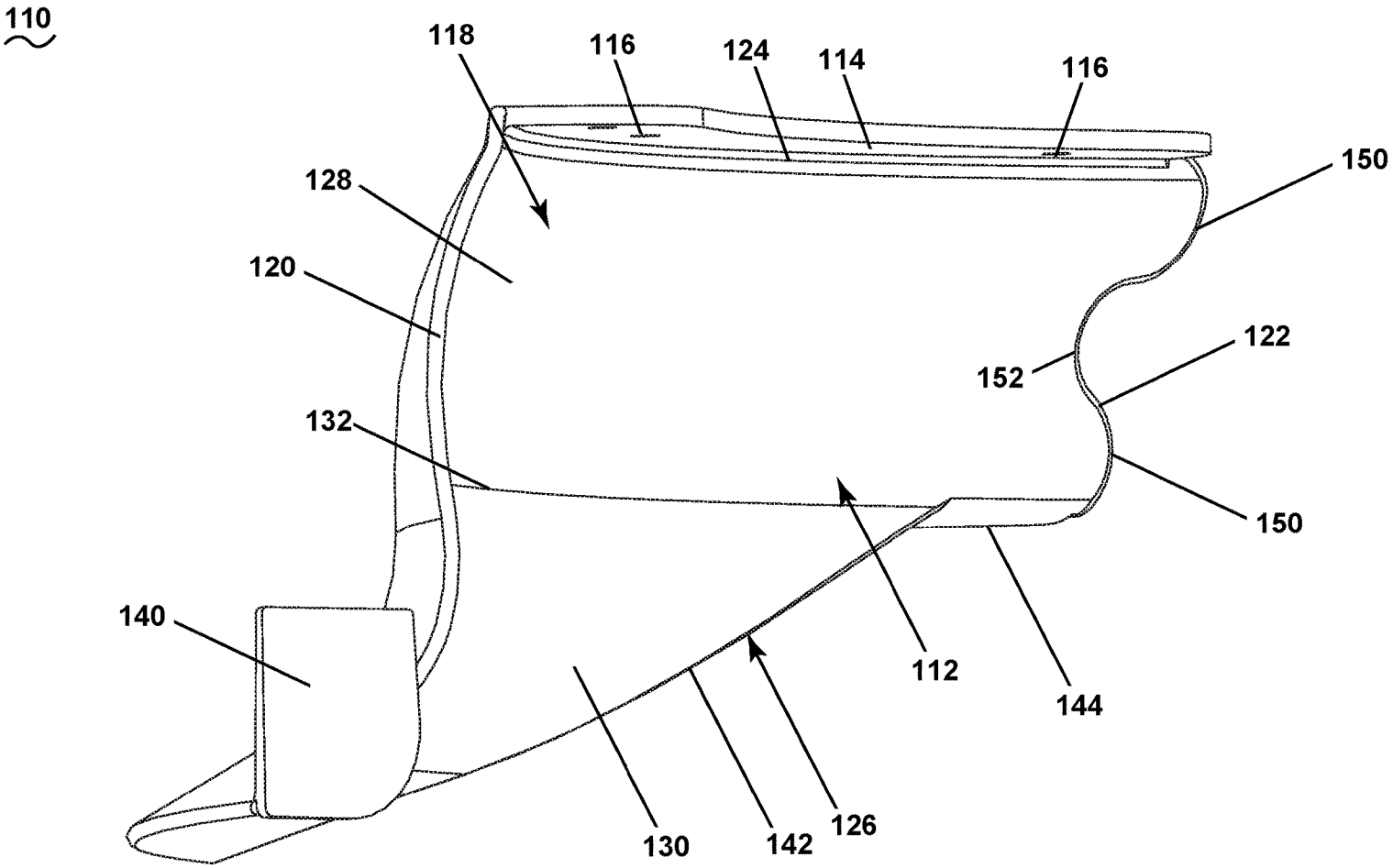
FIG. 4 is a side view of one blade of the impeller of FIG. 1.

Referring now to FIG. 4, a single blade 110 is shown, disconnected from the rest of the impeller 92 and the remainder of the blades. The blade 110 includes a blade body 112 having a top wall 114 that can include a set of openings 116 for mounting the blade 110 to the rest of the impeller 92, or mounting the impeller 92 (to which the blade is attached) to the rotor 98. A working wall 118 extends from the top wall 114. The working wall 118 extends between a root 120 and a tip 122, defining a span-wise direction. The root 120 can couple to or extend from the remainder of the impeller 92. The working wall 118 also extends from a top edge 124 to a bottom edge 126, defining a chord-wise direction.

The working wall 118 includes a curved geometry. More specifically, the working wall 118 can be separated into a top portion 128 and a bottom portion 130, separated by a line of delineation 132. The top portion 128 can define a concave surface 132, relative to the extent of the top wall 124. The concave surface 132 can be defined in both the chord-wise direction and the span-wise direction, forming a 'cupped' geometry, or an ellipsoidal curvature for the top portion 128.

The bottom portion 130 can define a 'saddle' geometry. The bottom portion 130 can include convex geometry, defined in the chord-wise direction, and further defining the line of delineation 132 as a line of inflection between the concave structure of the top portion 128 and the convex structure of the bottom portion 130, defined in the chord-wise direction. Furthermore, the bottom portion 130 can include a concave geometry, defined in the span-wise direction, relative to the extent of the top wall 114. The saddle geometry for the bottom portion 130 is defined by the convex geometry in the chord-wise direction and the concave geometry defined in the span-wise direction, defining a hyperbolic paraboloid shape for the bottom portion 130. As can be appreciated, the shape of the top portion 128 and the bottom portion 130 define a serpentine profile in the chord-wise direction.

A bottom wall 140 extends from the root 120 at the bottom edge 126, and can be utilized for mounting the blade 110 to the remainder of the impeller 92. It should be appreciated that the bottom wall 140 can be optional, such as if the blade 110 is formed integrally with the rest of the impeller 92.

The bottom edge 126 further defines the bottom portion 130. The bottom edge 126 includes a curved portion 142, which terminates at a linear portion 144. The curved portion 142 extends from the root 120 toward the tip 122 to the linear portion 144, while the linear portion 144 extends from the curved portion 142 to the tip 122. It should be understood that the bottom edge 126 is also defined by the 'cupped' or curved geometry of the hyperbolic paraboloid shape of the bottom portion 130.

Figure 5:
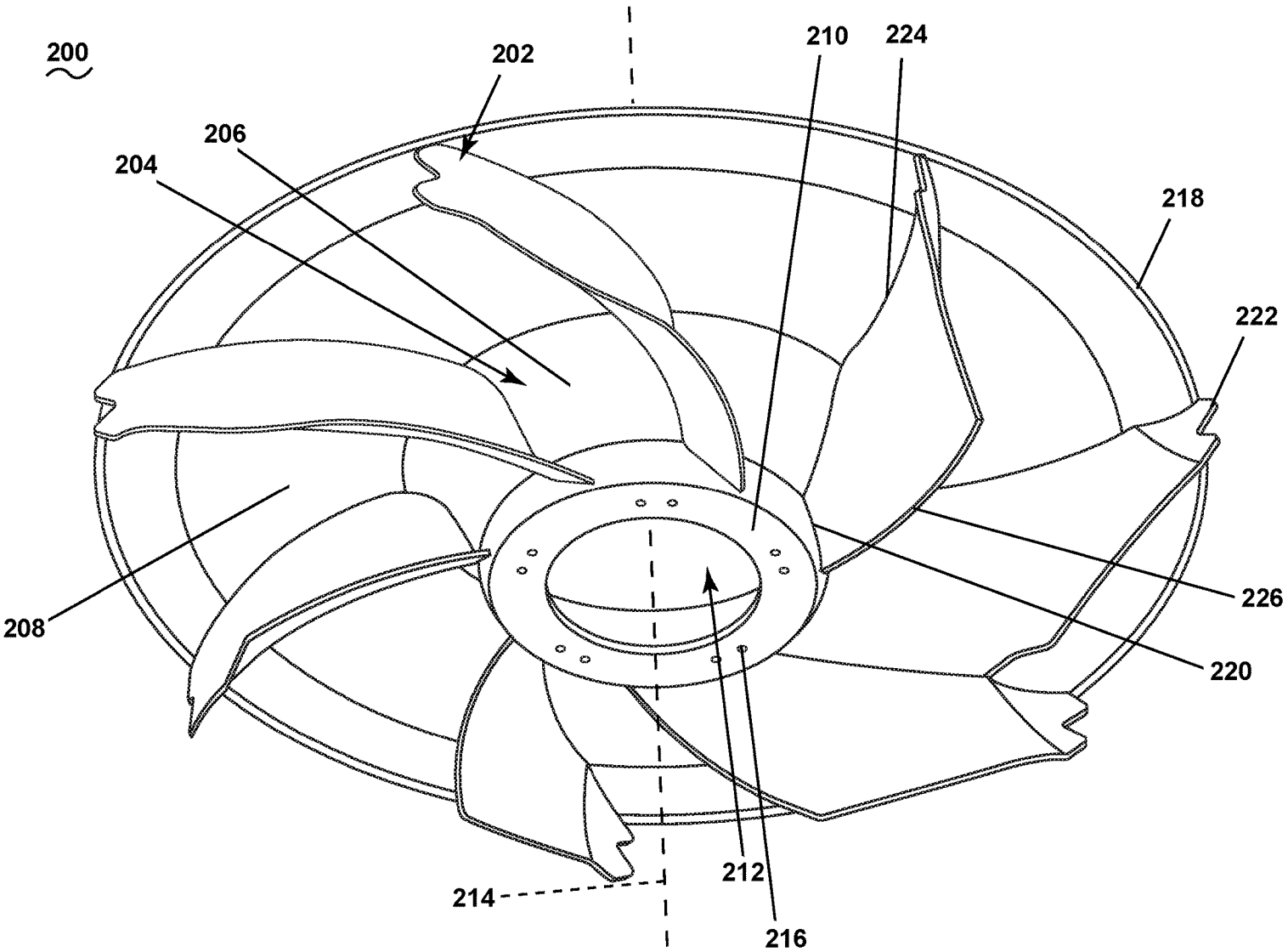
FIG. 5 is a bottom perspective view of another exemplary impeller including a set of blades.
Figure 6:
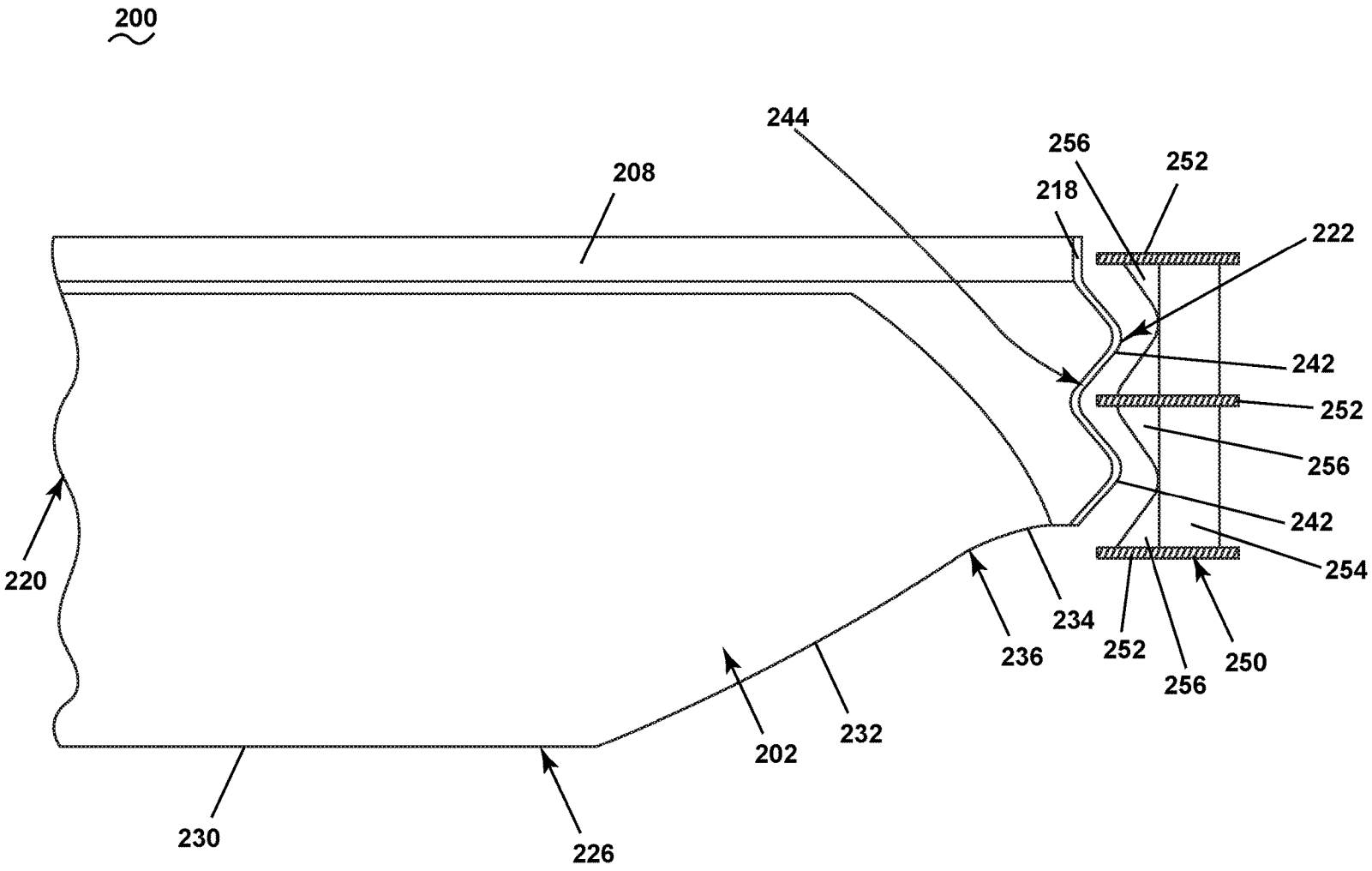
FIG. 6 is an enlarged side view of one blade of the set of blades of FIG. 5.

The tip 122 of the blade 110 includes a generally sinusoidal shape, having a pair of extensions 150 separated by a valley 152. The extensions 150 are curved, such that the tip 122 is formed having the sinusoidal shape, or a somewhat saw-toothed shape. While shown as being generally curved or rounded, it is contemplated that the extensions 150 can be any other shape, such as linear, curvilinear, or a combination thereof, in non-limiting examples. In another non-limiting example, each extension 150 can include a deltate shape, such as a triangular shape, while still being rounded, similar to that as shown in FIG. 5 or 6, and discussed in detail below. Additional non-limiting examples can include a jagged shape, or having the extensions formed geometrically, such as having a hexagonal shape, or a squared shape. Furthermore, as shown, the tip 122 includes two extensions 150, while it should be appreciated that there can be any number of extensions 150. The extensions 150 can further follow the ellipsoidal shape of the remainder of the top portion 128 of the body 112.

In operation, the impeller 92 is rotatably driven by the motor assembly 94, such that the blades 110 move a volume of air from the inlet 76 to the outlet 78. As the blades 110 are driven, air is moved along a leading side or face of the blade 110. The air is moved along the blade 110 toward the extensions 150 at the tip 122, where the air divides and passes to both extensions 150. As the air moves over the extensions 150, vortices are formed in the airflow. The vortices from the adjacent extensions 150 rotate in opposite directions, and cancel one another out, similar to a destructive interference effect. The blade design provides for increased operational efficiency by also reducing drag, while decreasing or minimizing noise and vibration generated by the vortices formed at the extensions 150. The curved, rounded shape of the extensions 150 in sinusoidal arrangement provide for decreased noise and vibration, as compared to blades without the extensions. Further, the extensions decrease the noise and vibration, while improving operational efficiency by reducing induced drag on the impeller 92. Similarly, the geometry of the blades 110 further facilitates the decreased noise and vibration, while maintaining operational efficiency.

Referring to FIG. 5, another exemplary impeller 200 is shown, which includes a set of blades 202 extending radially from an inner annular hub 204 formed as a radially inner wall 206 of the impeller 200. A top wall 208 extends radially outward from the hub 204 with a top edge of each blade of the set of blades 202 coupled to the top wall 208. A bottom flange 210 extends radially inwardly from the hub 204 opposite of the top wall 208. A central opening 212 is defined in the impeller by the bottom flange 210. A central axis 214 can be defined extending through the central opening 212, where the central axis 214 is defined perpendicular to the annular, radial extent of the impeller 200. Additionally, a set of fastener apertures 216 are provided in the bottom flange 210 for mounting the impeller 200 to the rest of the ceiling fan, such as to the motor or rotor. An outer edge 218 is provided radially about the top wall 208.

Each blade 202 extends in a span-wise direction between a root 220 and a tip 222, with the root 220 attached to the hub 204. The root 220 can join the hub 204 at the radially inner wall 206, terminating above the bottom flange 210. Each blade 202 includes a first edge 224 coupled to and extending along the top wall 208, and a second edge 226, which extends from the root 220 to the tip 222 opposite of the first edge 224. The tip 222 can extend radially exterior of the outer edge 218.

As can be appreciated, each blade 202 of the set of blades 202 is curved. More specifically, each blade curves in a direction relative to a radius extending from the central axis 214, defining an arcuate shape for the blades 202. Similarly, it should be appreciated that the blades 202 also curve in a direction parallel to the central axis 214 and perpendicular to the radius therefrom. Therefore, each blade of the set of blades 202 can include a hyperbolic paraboloid shape, also known as a 'saddle' shape.

While the impeller 200 is shown as having seven blades, it should be appreciated that any number of blades is contemplated. The number of blades 202 can provide for improving or maximizing operational efficiency, or improving or maximizing total flow output.

Referring to FIG. 6, a side view of a portion of the impeller 200 is shown, better depicting a side view of one blade 202 of the set of blades 202. The second edge 226 of the blade 202 includes a linear portion 230 that extends from the hub 204. A first curved portion 232 extends toward the tip 222 from the linear portion 230, continuing to define the second edge 226. The first curved portion 232 can include a slight curvature, defining a convex shape. A second curved portion 234 extends from the first curved portion 232 toward the tip 222. The second curved portion 234 can be a concave portion, defining an inflection point 236 at the junction between the first curved portion 232 and the second curved portion 234. The second curved portion 234 can terminate at the tip 222. It should be appreciated that different shapes for the second edge 226 are possible, such as a linear edge, a wholly curved edge, such as wholly concave or convex, or any combination thereof, in non-limiting examples.

The tip 222 of the blade 202 includes a pair of extensions 242 extending radially outward at the tip 222. The extensions 242 can be curvilinear, defining rounded tips at the radial end of the pair of extensions 242, and further defining the tip 222 of the blade 202. More specifically, the extensions 242 include a deltate shape, referring a triangular shape, and shown here as a rounded deltate shape extending at the tip 222. It should be appreciated that while only two extensions are shown, additional extensions are contemplated. A valley 244 is formed at the tip 222 between the pair of extensions 242. The extensions 242 terminate at the top wall 208 at the outer edge 218.

An outer grill 250 can be mounted to the ceiling fan. It should be understood that the grill 250 can be an annular assembly, mounted to or within the ceiling fan, surrounding and protecting the impeller 200. The outer grill 250 can include a set of annular stabilizing ribs 252, shown in cross section, which are interconnected by a set of vertical outer walls 254. Each vertical outer wall 254 can include a set of extensions 256 arranged complementary to the extensions 242. The outer walls 254 can be angled relative to or collinear with the direction of air emitted by the blades 202, such that the outer walls 254 can be locally aligned with the direction of airflow. Such an alignment can further reduce turbulence. Further still, it is contemplated that the outer walls 254 can rotate about a vertical axis, such that the outer walls can self-align with the local direction of airflow. The grill 250 further provides for shielding and protecting the impeller 200 from foreign objects.

It should be appreciated that the impeller blades 202 as shown and described herein provide for improved efficiency for the ceiling fan 10. The tip 222 including the extensions 242 and valley 244 provide for improved airflow efficiency for the airflow drawn into and pushed out of the ceiling fan.

The impeller 200 and the set of blades 202 attached thereto provide for improved and increased efficiency as well as improved and increased airflow. The extensions 242 on the tip 222 of the blade 202 further provide for improving efficiency, as well as decreasing noise or vibration generated by operation of the impeller.

Figure 7:
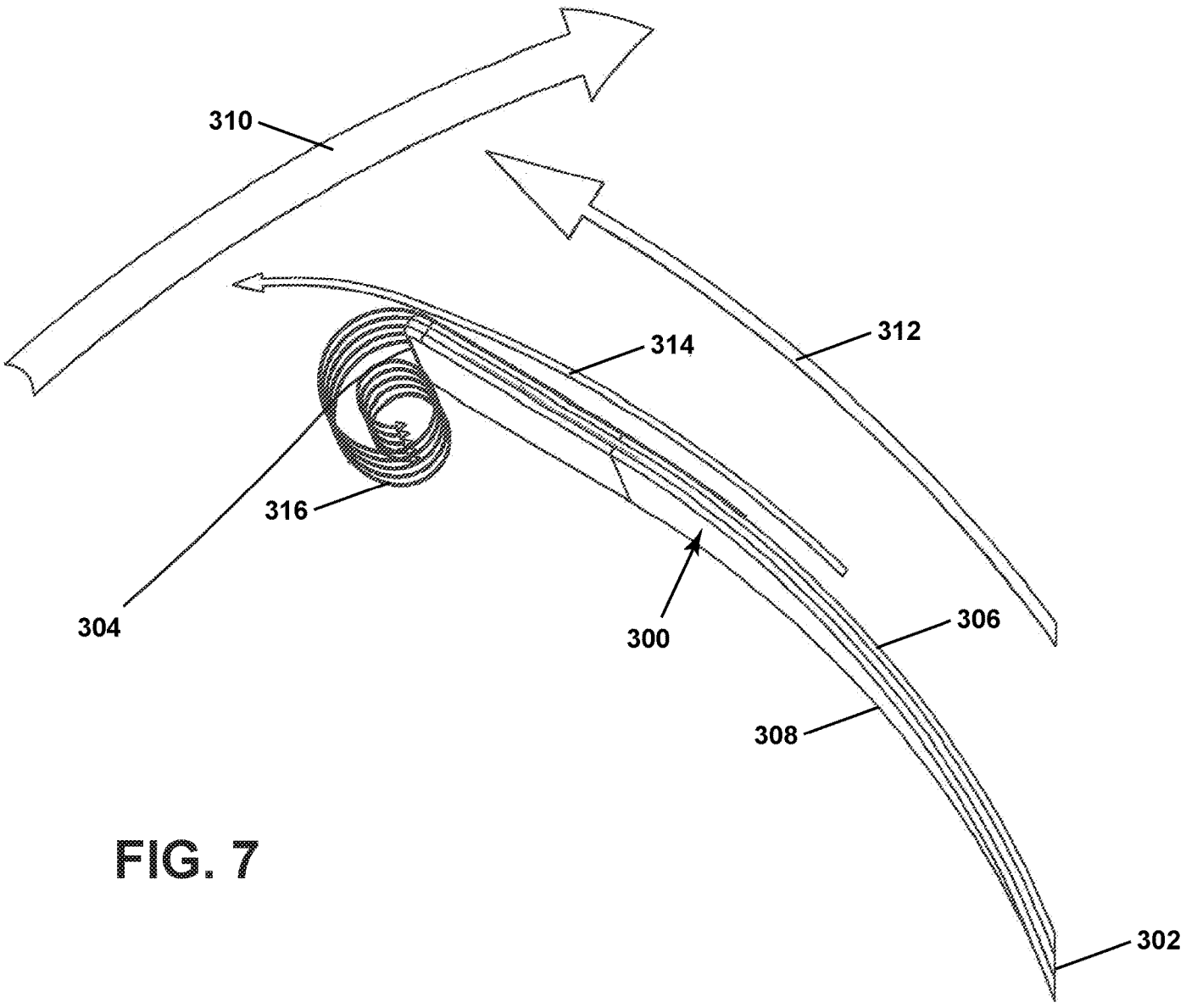
FIG. 7 is a view illustrating the airflow generated along a traditional impeller blade.

Referring to FIG. 7, a chord-wise view of one blade 300 is shown, which can be a traditional impeller blade, for example. The blade 300 extends between a root 302 and a tip 304, in a span-wise direction, and between a first edge 306 and a second edge 308 in a chord-wise direction. A first arrow 310 indicates a direction of rotation of the blade 300, as driven by an impeller assembly (not shown). Due to the driven direction of the blade 300, the airflow that is driven by the blade 300 is shown by a second arrow 312 indicating the airflow direction along the blade 300. As air 312 moves across the blade 300, there is a boundary layer flow 314, indicated by a third arrow 314. The boundary layer flow 314 attaches itself to and passes along the surface of the blade 300. At the tip 304, the boundary layer flow 314 passes over the tip 304 and generates a vortex flow 316. The vortex flow 306 can generate vibration or noise, which is undesirable to a consumer, and can even result in damage or reduce lifetime for the fan.

Figure 8:
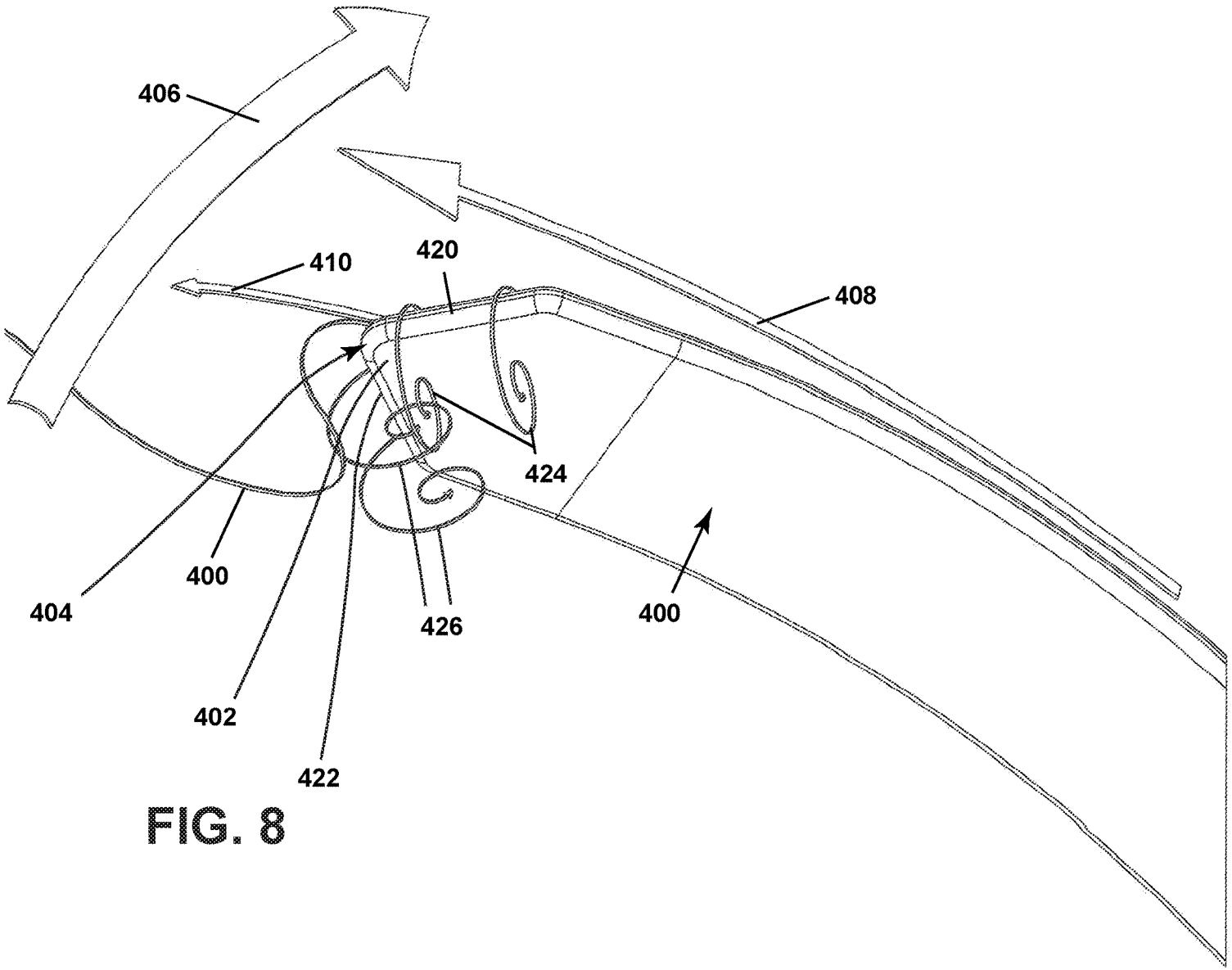
FIG. 8 is a view illustrating the airflow generated along an impeller blade having an extension.

Referring to FIG. 8, showing another blade 400, which can be the blades 110, 202 as described herein, or a portion thereof, such as illustrating only a single extension 402 provided at a tip 404, while more or different extensions, such as those described in FIGS. 1-6, are contemplated, and the single extension is merely used to show the benefits of the function of the extension. The extension 402 includes a deltate or rounded triangular shape.

Similar to that as described in FIG. 7, a direction of rotation is shown by a first arrow 406, the direction of airflow from the driven blades 400 is shown by a second arrow 408, and a boundary layer flow is shown by a third arrow 410, extending from the tip 404.

The tip 404, due to its deltate shape, includes a first edge 420 and a second edge 422. As can be appreciated, the boundary layer 410 can curl around the tip 404, generating vortices 424 426 at each respective edge 420, 422. Each vortex is generated and swirls in a direction that is substantially perpendicular to the respective edge 420, 422, while substantially perpendicular means that there can be minor fluctuations or changes from a strict perpendicular arrangement. It should be appreciated that at least some of the air flow passing from the tip 404 will be driven radially outwardly, shown as flow line 428, which can be curved or otherwise affected by the vortices extending from the tip 404.

The vortices 424, 426 flow in somewhat offset or opposite directions, relative to one another, where an offset or opposite direction can be defined by the angular offset among the edges 420, 422 that generate the vortices 424, 426. It should be understood that the opposite directions or otherwise angular offset need not be in a wholly opposite direction, but simply an offset from one another such that a local portion of the airflow is offset by an angular dimension. More specifically, a direction need not be wholly opposite in a three-dimensional geometry, while a two-dimensional plane. As shown, each vortex is offset from the adjacent vortex by about ninety-degrees, while the local offsets within the flows themselves can vary with the vortical motion of the vortices 424, 426.

The offset arrangement of the generated vortices 424, 426 provides for cancelling the vortices 424, 426 or a portion thereof, by destroying or decreasing local intensity or strength of the vortices 424, 426 when they contact or interact with one another. Such destruction or decrease of strength decreases noise, vibration, and parasitic drag, while increasing efficiency.

Figure 9:
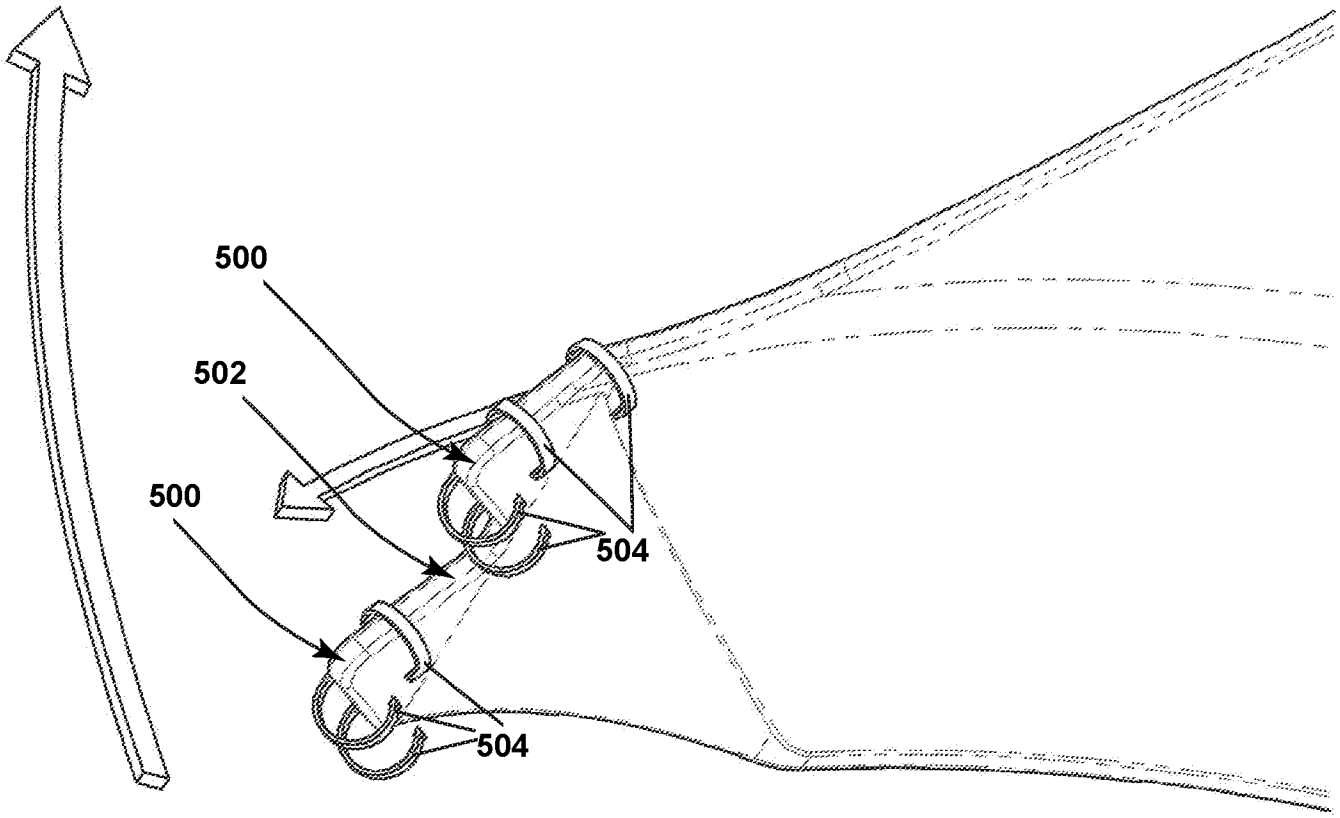
FIG. 9 is another view illustrating an airflow generated along an impeller blade having two extensions.

FIG. 9 can be similar to FIG. 8 except that FIG. 9 includes a pair of extensions 500 extending from a tip 502, as compared to FIG. 8 that only includes a single extension. It should be appreciated that the extensions shown in FIGS. 8 and 9 are exemplary, and need not be limiting of the invention as shown, and that different extensions as described herein are possible.

The extensions 500 in FIG. 9 each generate offset of opposing vortices 504, which can be used to reduce or minimize the noise or vibrations generated locally, at each extension 500. Thus, a sawtooth or sinusoidal arrangement provides for set or series of extensions 500, which can locally or discretely reduce the local vibrations and noise, where larger-sized extensions 500 or a lesser number of extensions 500 may generate greater noise or vibration as compared to that of a set of smaller-sized extensions, or a greater overall amount of extensions.

Although the embodiments of the present invention have been shown and described, it would be appreciated by those skilled in the art that changes may be made in these embodiments without departing from the principles and spirit of the invention. Although specific terms are employed herein, they are used in a generic and descriptive sense only and not for purposes of limitation. For example, the blade of FIG. 4 could be incorporated into the impeller of FIG. 5.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A ceiling fan comprising:

a body having an outer periphery and a bottom, the body defining an annular air flow passage with an annular inlet in the bottom, and an annular outlet provided on the outer periphery of the body;

a motor having a rotor, defining a rotational axis, with at least a portion of the rotor located within the body;

an impeller mounted to the rotor to move air through the air flow passage;

an annular grill located radially exteriorly of the impeller and circumscribing the annular outlet such that air passing through the annular air flow passage and exiting the annular outlet passes through the grill; and a set of blades provided on the impeller, the set of blades located within the annular air flow passage and circumferentially spaced about the annular air flow passage, with at least one blade of the set of blades extending from a root to a tip in a span-wise direction, and extending from a first edge to a second edge defining a chord-wise direction, wherein at least some tips of the blades include an extension extending outward at the tip.

2. The ceiling fan of claim 1 wherein the second edge includes a straight linear portion extending radially outwardly from the root.

3. The ceiling fan of claim 2 wherein the second edge further includes a first curved portion extending from the straight linear portion.

4. The ceiling fan of claim 3 wherein the first curved portion is convex.

5. The ceiling fan of claim 3 wherein the second edge further includes a second curved portion extending from the first curved portion.

6. The ceiling fan of claim 5 wherein the second curved portion is concave.

7. The ceiling fan of claim 6 wherein an inflection point is defined on the second edge at a junction between the first curved portion and the second curved portion.

8. The ceiling fan of claim 6 wherein the second curved portion terminates at the tip.

9. The ceiling fan of claim 1 wherein the extension is curvilinear.

10. The ceiling fan of claim 1 further comprising a second extension defining a valley between the extension and the second extension.

11. The ceiling fan of claim 1 wherein each blade of the set of blades includes a hyperbolic paraboloid shape.

12. The ceiling fan of claim 1 wherein the annular grill further includes a set of grill extensions arranged complementary to the extensions extending from the tip of each blade of the set of blades.

13. The ceiling fan of claim 1 wherein the annular grill includes a set of ribs connected by a vertical wall, wherein the vertical wall can be angled complementary to a flow of air exhausting from the annular air flow passage.

14. A blade for a ceiling fan impeller, the blade comprising:

a body extending between a root and a tip, defining a span-wise direction, and extending between a first edge and a second edge, defining a chord-wise direction; and a set of extensions extending from the body at the tip;

wherein the second edge includes a straight linear portion extending radially outwardly from the root and the second edge extends between the root and the tip, and includes a first curved portion and a second curved portion.

15. The blade of claim 14 wherein the first curved portion is convex and the second curved portion is concave, and the first curved portion meets the second curved portion at an inflection point.

16. An impeller for a ceiling fan comprising:

a hub having an inner wall defining an interior motor chamber, and a top wall extending radially from an upper edge of the inner wall;

a set of blades extending radially from the hub;

wherein each blade of the set of blades includes a root and a tip and opposing first and second edges, with the first edge spaced from the second edge, and which extend between the root and the tip, wherein the root is attached to the inner wall, the first edge is attached to the top wall, and the tip includes a set of extensions extending radially outwardly from each blade of the set of blades;

wherein each blade of the set of blades includes a bottom edge extending between the root and the tip, with the bottom edge including a straight linear portion extending from the root, a convex portion extending from the straight linear portion, and a concave portion extending between the convex portion and the tip.

17. The impeller of claim 16 wherein each blade of the set of blades includes a hyperbolic paraboloid shape.

18. A ceiling fan comprising:

a body defining an air flow passage with an inlet provided on a lower surface of the body and an outlet provided on an outer periphery of the body;

a motor having a rotor, with at least a portion of the rotor located within the body;

an impeller mounted to the rotor to move air through the air flow passage;

a grill located radially exteriorly of the impeller and facing circumscribing the outlet such that air passing through the air flow passage and exiting the outlet passes through the grill; and a set of blades provided on the impeller, the set of blades located within the flow passage and circumferentially spaced about the flow passage, with at least one blade of the set of blades extending from a root to a tip in a span-wise direction, and extending from a first edge to a second edge defining a chord-wise direction, wherein at least some tips of the blades include an extension extending outward at the tip, the second edge includes a straight linear portion extending radially outwardly from the root, and the second edge further includes a first curved portion extending from the straight linear portion.

* * * * *